United States Patent [19]

Kiyoshige et al.

[11] Patent Number: 4,558,998

[45] Date of Patent: Dec. 17, 1985

[54] VARIABLE CAPACITY TYPE VANE PUMP WITH BALANCING GROOVE IN THE CAM RING

[75] Inventors: Satoshi Kiyoshige, Tokyo; Tadashi Fujikawa, Sagamihara; Shinsuke Eguchi, Fujisawa, all of Japan

[73] Assignee: Nissan Motor Co., Ltd., Yokohama, Japan

[21] Appl. No.: 636,415

[22] Filed: Jul. 31, 1984

[30] Foreign Application Priority Data

Aug. 4, 1983 [JP] Japan ..... 58-142875

[51] Int. Cl.[4] ..... F04C 2/00; F04C 15/04

[52] U.S. Cl. ..... 418/26; 418/30; 418/178; 418/257

[58] Field of Search ..... 418/24–27, 418/30, 133, 257, 178; 417/220

[56] References Cited

U.S. PATENT DOCUMENTS 1,943,929 1/1934 Rayburn ..... 418/26
2,592,247 4/1952 Coe .
2,775,946 1/1957 Hufferd ..... 418/27

FOREIGN PATENT DOCUMENTS 57-62986 4/1982 Japan ..... 418/30
572737 10/1945 United Kingdom ..... 418/30
2026094 1/1980 United Kingdom .

*Primary Examiner*—John J. Vrablik
*Attorney, Agent, or Firm*—Schwartz, Jeffery, Schwaab, Mack, Blumenthal & Evans

[57] ABSTRACT

In a vane pump having a casing, an annular rotor rotatably disposed in the casing, a plurality of vanes longitudinally movably carried by the rotor, and a cam ring eccentrically disposed about the rotor with its cylindrical inner surface slidably contacting with the leading ends of the vanes, the cam ring having at the diametrically opposed portions thereof inlet and outlet ports which face in the same direction, there is proposed a measure in which a groove is formed in the cam ring near the inlet port and faces in the same direction as the inlet and outlet ports, and in which the groove is connected to the outlet port for balancing the cam ring.

10 Claims, 3 Drawing Figures

FIG. 2
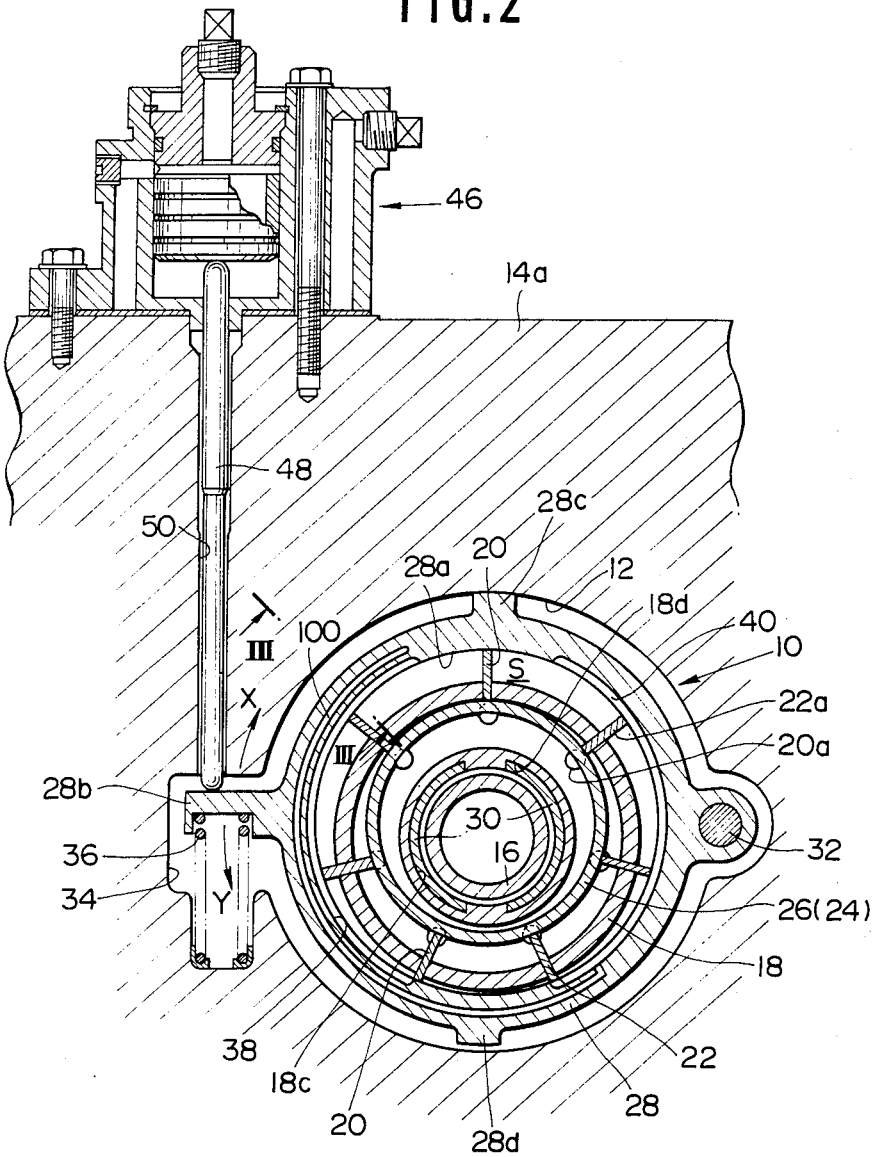
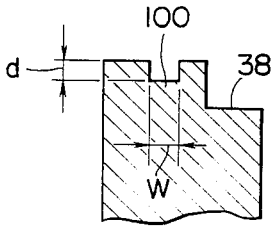
FIG. 3

VARIABLE CAPACITY TYPE VANE PUMP WITH BALANCING GROOVE IN THE CAM RING

BACKGROUND OF THE INVENTION

1. Field of the Invention

The present invention relates in general to a vane pump, particularly to a variable capacity type vane pump which can vary its pumping capacity by changing the position of a cam ring, and more particularly to a variable capacity type vane pump which is constructed to have inlet and outlet ports at the diametrically opposed portions of the cam ring.

2. Description of the Prior Art

Hitherto, various kinds of variable capacity type vane pumps have been proposed and put into practical use, which are constructed to vary the pumping capacity by changing the position of a part thereof. Some are of a type which comprises an annular rotor driven by an external power source, a plurality of vanes longitudinally movably carried by the rotor, and a cam ring eccentrically disposed about the rotor with its cylindrical inner surface slidably contacting with the leading ends of the vanes. Upon rotation of the rotor and thus the vanes about the axis of the rotor, working fluid is conveyed by each cell defined by the adjacent vanes from an inlet port to an outlet port. During this conveyance, the working fluid is compressed and thus enforcedly discharged to the downstream conduit line of the outlet port. Usually, by the constructional inherency of the pumps of such type, the inlet and outlet ports are formed at the diametrically opposed portions of the cam ring. However, this type pump has the following drawback. That is, under operation of the pump, one half section of the cam ring where the outlet port is formed is biased in one axial direction away from the outlet port by the highly pressurized working fluid in the outlet port, while the other half section of the cam ring where the inlet port is formed is not subjected to such biasing action because the working fluid in the inlet port is relatively low in pressure (that is, about atmospheric pressure). This induces an ill-balanced condition of the cam ring, so that deformation of the cam ring sometimes occurs. With the deformed cam ring, it is impossible to carry out a smooth and accurate pumping operation.

SUMMARY OF THE INVENTION

It is therefore an essential object of the present invention to provide an improved variable capacity type vane pump which is free of the above-mentioned drawback.

According to the present invention, there is provided a vane pump which comprises a casing having a mounting space defined therein, an annular rotor disposed in the mounting space in a manner to be rotatable about the axis thereof, a plurality of vanes carried by the annular rotor in a manner to be radially projectable from the rotor, a cam ring eccentrically disposed about the rotor with its cylindrical inner surface slidably contacting with the leading ends of the vanes, the cam ring having at the diametrically opposed portions thereof inlet and outlet ports which face in the same direction, and means defining in the cam ring at the position near the inlet port a groove which faces the same direction as the inner and outer ports, the groove being connected to the outlet port.

BRIEF DESCRIPTION OF THE DRAWINGS

Objects and advantages of the present invention will become apparent from the following description when taken in conjunction with the accompanying drawings, in which:

FIG. 2 is a sectional view taken along the line II—II of FIG. 1; and

FIG. 3 is an enlarged sectional view taken along the line III—III of FIG. 2.

DETAILED DESCRIPTION OF THE INVENTION

Figure 1:
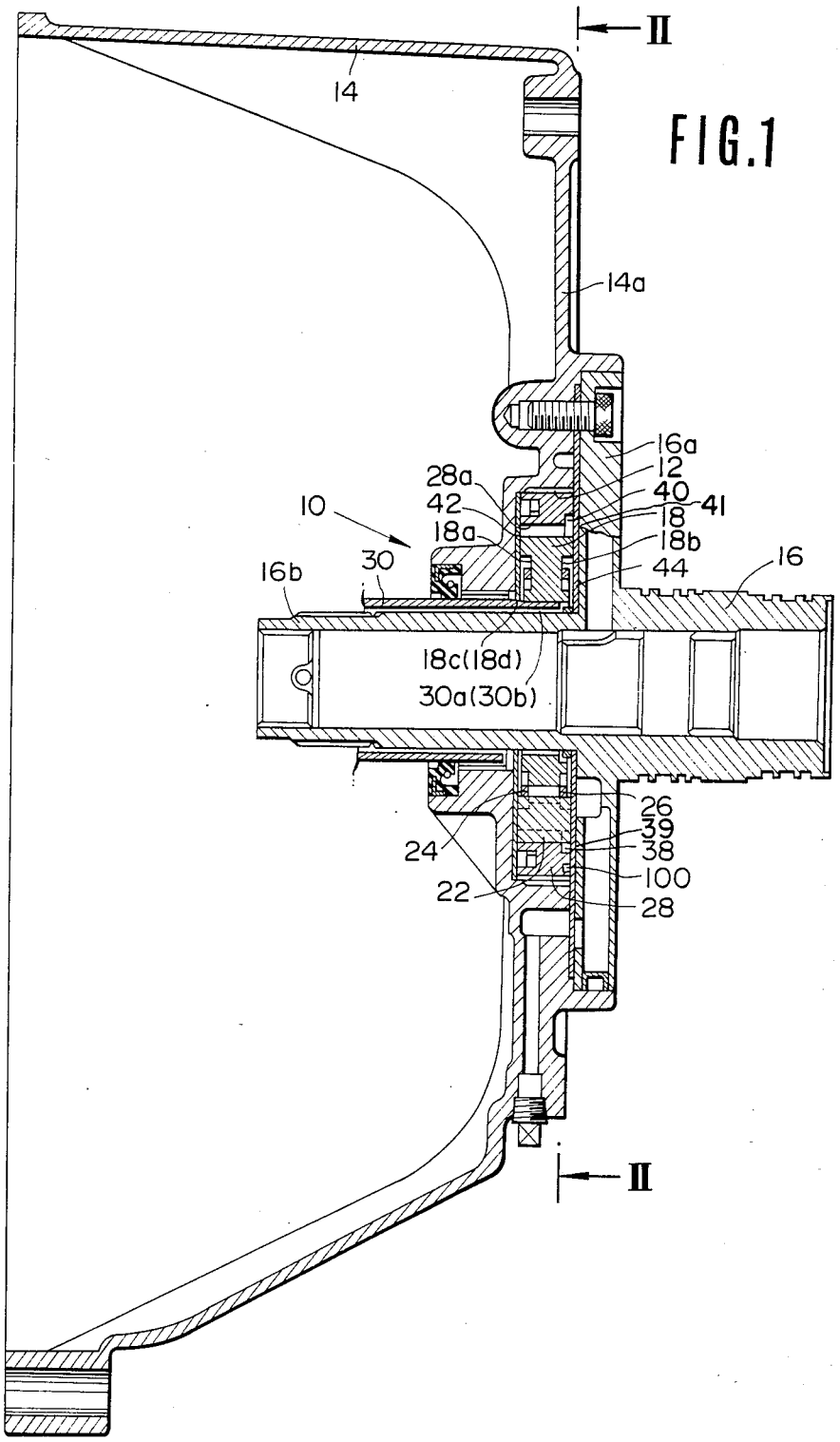
FIG. 1 is a sectional elevation of a variable capacity type vane pump according to the present invention, which is shown to be used as an oil pump for an automatic transmission.

Referring to FIGS. 1 and 2 of the drawings, there is shown a variable capacity type vane pump 10 of the present invention. The pump 10 is shown as being used as an oil pump of an automatic transmission.

The vane pump 10 is housed and assembled in a circular recess 12 formed in the bell-housing section **14*a* of a torque converter casing 14. As will become apparent as the description proceeds, the circular recess 12 is so sized that the vane pump assembly 10 is pivotally movable therein. As is seen from FIG. 1, the recess 12 is covered by a circular flange 16*a* of a fixed hollow shaft 16. The hollow shaft 16 is secured to the bell-housing section 14*a* with one hollow shaft section 16*b* projected through the central bore portion of the recess 12 into the torque converter casing 14, as shown. Thus, a generally annular mounting space for the oil pump 10 is defined around the hollow shaft 16. Although not shown in the drawing, an input shaft of an automatic transmission (which is located in the right side section of FIG. 1) is rotatably received in the hollow shaft 16**, so that the output of the torque converter is transmitted through the input shaft to the transmission.

The vane pump 10 comprises an annular rotor 18 which is coaxially and rotatably disposed about the hollow shaft 16. As is understood from the drawings, the rotor 18 is formed at its axially opposed sides with annular grooves **18*a* and 18*b* which are concentric with the rotor 18. As is best seen in FIG. 2, the rotor 18 is formed with a plurality (seven in the disclosed example) of radially extending slits 20 (only two are numbered in FIG. 2) which are equally spaced from one another. Each slit 20 extends radially outwardly from the grooved portion of the rotor 18 (that is, the portion where the grooves 18*a* and 18*b* are located) to the cylindrical outer surface of the same. The radially inward end of each slit 20 is circularly enlarged, which is designated by numeral 20*a*. A plurality (seven) of vanes 22 (only two are numbered in FIG. 2) are slidably received in the slits 20 so that they are projectable radially outwardly from the associated slits 20. Two annular vane rings 24 and 26 are respectively and eccentrically disposed in the annular grooves 18*a* and 18*b* of the rotor 18 in a manner to slidably carry thereon the inward ends of the vanes 22. With the eccentric positional relationship between the rotor 18 and the vane rings 24 and 26, the lengths of the vanes 22 projected from the rotor 18 become different as is understood from FIG. 2. A cam ring 28 constructed of sintered metal is spacedly and eccentrically disposed about the rotor 18 with its cylindrical inner surface 28*a* slidably contacting with the radially outward ends of the vanes 22. It is to be noted that upon proper assembly, the cam ring 28, and the vane rings 24 and 26 are arranged concentric with each other, so that rotation of rotor 18 induces movement of the vanes 22 together with the vane rings 24 and 26, about the axis of the cam ring 28. Designated by "S" is the crescent-shaped space defined between the rotor 18 and the cam ring 28, which space is partitioned into seven different-sized cells by the outwardly projected sections of the vanes 22. As is seen from FIG. 2, the inner cylindrical surface of the central bore of the rotor 18 is formed with diametrically opposed two axially extending grooves 18***c* and 18*d* with which two semicylindrical leading ends 30*a* and 30*b* of a hollow shaft 30 are tightly engaged in a spline-connection manner. As is seen from FIG. 1, the hollow shaft 30 is coaxially and rotatably disposed about the inwardly projected section 16*b* of the fixed hollow shaft 16 and connected to a pump impeller (not shown) of the torque converter to rotate therewith. Thus, the rotor 18 is driven by the pump impeller through the shaft 30. The cam ring 28 is pivotally connected at one end to the bell-housing section 14*a* of the casing 14 through a pin 32. The cam ring 28 is formed at the other end with an arm 28*b* which extends radially outwardly. A suitable space 34 is formed in the bell-housing section 14*a* for receiving therein the arm 28*b*, which space 34 is merged with the recess 12 of the casing 14. A spring 36 is compressed between the arm 28*b* of the cam ring 28 and the bottom of the space 34 so that the cam ring 28 is biased to pivot in a given direction, that is, in clockwise direction in FIG. 2 about the pin 32. In order to limit the clockwise and counterclockwise movements of the cam ring 28, it has at its diametrically opposed portions projections 28*c* and 28*d* which are contactable with the cylindrical wall of the recess 12.

As is seen from the drawings, the cam ring 28 is formed at one inner cylindrical edge portion thereof with inlet and outlet arcuate ports grooves 38 and 40 which are arranged at the diametrically opposed portions of the cam ring 28. As is seen from FIG. 1 two side plates 42 and 44 are attached to the axially opposed inner sides (no numerals) of the circular recess 12 and slidably and sealingly contact both the axially opposed sides of the cam ring 28 and the axially opposed sides of the rotor 18, so that the crescent-shaped space S is hermetically sealed from the outside. Thus, under rotation of the rotor 18 in the clockwise direction in FIG. 2, the oil at the inlet groove 38 is conveyed by each cell defined by the adjacent vanes 22 to the outlet groove 40. During this conveyance, the oil is compressed and thus enforcedly discharged to the downstream conduit line of the outlet groove 40, such as the lines in the torque converter and the lines in the automatic transmission. As shown in FIG. 1, known inlet and outlet ports 39 and 41 are formed in the side plate 44 and are connected to the inlet groove 38 and outlet groove 40, respectively.

An actuating device is employed for varying the pumping capacity of the pump 10 in accordance with the engine rotation speed. The device comprises generally a known hydraulically operated actuator 46 the operation of which is controlled by the oil pressure prevailing in the outlet groove 40 of the pump 10. The actuator 46 has an actuating rod 48 which extends to the afore-mentioned arm 28*b* of the cam ring 28 through an elongate bore 50 formed in the bell-housing section 14*a* of the casing 14. Thus, the axial movement of the rod 48 due to the operation of the actuator 46 changes the angular position of the cam ring 28 relative to the rotor 18, that is, the shape of crescent-shaped space "S", thereby changing the pumping capacity of the pump 10. That is, when the rod 48 is in its upper position permitting the cam ring 28 to assume its uppermost position as shown in FIG. 2, the pump 10 exhibits the maximum pumping capacity, while, when the rod 48 is in its lower position permitting the cam ring 28 to assume its lowermost position, the pump 10 exhibits its minimum pumping capacity. In practical use, the actuating device is so set that under low speed operation of the engine, the pumping capacity is increased by moving the cam ring 28 in the direction of "X", while, under high speed operation of the engine, the pumping capacity is reduced by moving the cam ring 28 in the direction of "Y".

According to the present invention, there is employed the following measure for solving the aforementioned drawback encountered in the conventional vane pump.

The cam ring 28 is formed at its one side with an arcuate groove 100 which extends around the arcuate intake groove 38, as is seen from FIG. 2. One end of the groove 100 extends to the arcuate outlet groove 40 and connects the same, so that the pressure in the outlet groove 40 is introduced into the groove 100 under operation of the pump 10. Preferably, the width "W" (see FIG. 3) of the groove 100 is about 10 to 15% of thickness of the cam ring 28, and the depth "d" of the groove 100 is about 30 to 50% of the width "W". This is because, if the size of the groove 100 is much too great, a nonnegligible amount of working fluid is supplied to the groove 100 thereby affecting the pumping ability of the pump 10, and if the size of the groove 100 is much too small, the effect of it is insufficient.

In operation, the vane pump 10 is driven by the pump impeller through the shaft 30, so that the working fluid (oil) is fed from the inlet port 39 to the outlet port 41 as is described hereinbefore. During this, the interior of the groove 100 is kept relatively high in pressure because it is communicated with the outlet port 41 or outlet groove 40. That is, under operation of the vane pump 10, one half section of the cam ring 28 (the right half section of the ring 28 in FIG. 2) wherein the outlet groove 40 is provided is pressed against the plate 42 (see FIG. 1) by the highly pressurized working fluid in the outlet groove 40, and the other half section of the cam ring 28 (the left half section of the ring 28 in FIG. 2) wherein the inlet groove 38 and the groove 100 are provided is substantially equally pressed against the plate 42 (see FIG. 1) by the highly compressed working fluid in the groove 100. That is to say, the contact of the cam ring 28 to the plate 42 is well-balanced, so that the aforementioned undesirable deformation of the cam ring is not produced or is at least minimized. Thus, the pumping operation of the pump 10 according to the present invention is smoothly and accurately carried out.

What is claimed is:

1. A vane pump comprising:

a casing having a mounting space defined therein;

an annular rotor disposed in said mounting space in a manner to be rotatable about the axis thereof relative to said casing;

a plurality of vanes carried by said annular rotor in a manner to be radially projectable from said rotor;

at least one vane ring carried by said annular rotor and carrying thereon said vanes;

a cam ring eccentrically disposed about said rotor with its cylindrical inner surface slidably contacting with the leading ends of said vanes, said cam ring having, at one inner cylindrical end portion, diametrically opposed inlet and outlet grooves which face toward the same direction;

means for hermetically sealing a work chamber which is defined between said annular rotor and said cam ring, said work chamber being partitioned into several cells by said vanes;

means for defining inlet and outlet ports which are respectively connected to said inlet and outlet grooves; and means defining in said cam ring at the position near said inlet groove a balancing groove which faces in the same direction as that of said inlet and outlet grooves, said balancing groove extending to said outlet groove to connect the same.

2. A vane pump as claimed in claim 1, in which each of said inlet and outlet grooves is an arcuate recess which extends along an inner cylindrical edge portion of said cam ring, and in which said balancing groove is an arcuate recess which extends along and around said arcuate inlet groove.

3. A vane pump as claimed in claim 2, in which said balancing groove is connected to said outlet groove through a groove formed in the side at which said inlet and outlet grooves are formed.

4. A vane pump as claimed in claim 3, further comprising two plates which sealingly and slidably contact the axially opposed sides of said cam ring and sealingly and slidably contact the axially opposed sides of said rotor.

5. A vane pump as claimed in claim 4, in which the width of said balancing groove is approximately 10 to 15% of the thickness of said cam ring, and in which the depth of said balancing groove is approximately 30 to 50% of said width.

6. A vane pump as claimed in claim 5, further comprising an actuator which changes the angular position of said cam ring with respect to said annular rotor.

7. A vane pump as claimed in claim 6, in which said cam ring is pivotally connected at its one end to said casing through a pin.

8. A vane pump as claimed in claim 7, in which said cam ring is formed at a portion diametrically opposed to the pivoted portion with an arm which is engaged with an actuating rod of said actuator.

9. A vane pump as claimed in claim 8, in which said cam ring is biased to pivot in a direction to increase the eccentricity of said cam ring with respect to said rotor.

10. A vane pump as claimed in claim 5, in which said cam ring is constructed of a sintered metal.

* * * * *